United States Patent [19]

Ragon

[11] Patent Number: 4,621,764

[45] Date of Patent: Nov. 11, 1986

[54] PARTITION ASSEMBLY WITH INTERLOCKS HAVING GLUED TABS

[75] Inventor: Don C. Ragon, Whitefish Bay, Wis.

[73] Assignee: Rock-Tenn Company, Norcross, Ga.

[21] Appl. No.: 714,127

[22] Filed: Mar. 20, 1985

[51] Int. Cl.[4] ..... B65D 5/48

[52] U.S. Cl. ..... 229/15; 229/42; 493/91; 493/391; 493/912

[58] Field of Search ..... 229/15, 42, 29 B–29 E, 229/DIG. 4; 217/30–33; 493/90–92, 391, 912

[56] References Cited

U.S. PATENT DOCUMENTS

| | | | |
|---|---|---|---|
| 9,762 | 6/1881 | Jaeger | 217/32 |
| 1,137,732 | 5/1915 | Alfred . | |
| 1,771,760 | 7/1930 | MacLellan | 229/DIG. 4 |
| 2,549,801 | 4/1951 | George | 229/42 |
| 3,199,759 | 8/1965 | Hickin | 229/15 |
| 3,253,763 | 5/1966 | Henderson | 229/15 |
| 3,446,412 | 5/1969 | Stark | 229/15 |
| 3,640,445 | 2/1972 | Durham | 229/15 |
| 3,942,709 | 3/1976 | Gepfer | 229/15 |
| 4,219,146 | 8/1980 | Skaggs et al. | 229/15 |
| 4,226,357 | 10/1980 | Martin | 229/15 |

*Primary Examiner*—William Price
*Assistant Examiner*—Gary E. Elkins
*Attorney, Agent, or Firm*—Rogers, Howell, Moore & Haferkamp

[57] ABSTRACT

A partition assembly has longitudinal and cross partition strips with interlocks for joining the longitudinal and cross strips. Each interlock has a first slot in a longitudinal strip and a second slot in a cross strip. One of the slots has a tab with the side surface of the tab adhered to a wall of the strip having the other slot. The tab is foldable generally along the line of intersection of the strips to accommodate unfolding of the partition assembly between collapsed and expanded configurations.

12 Claims, 6 Drawing Figures

FIG. 1.
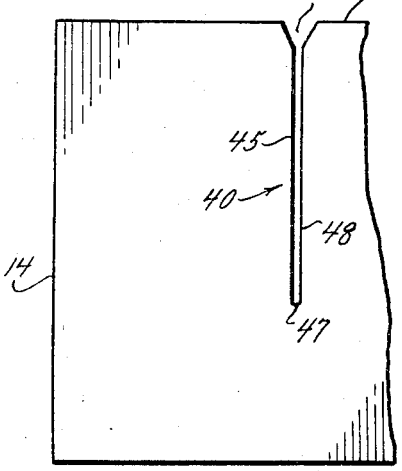
FIG. 2.
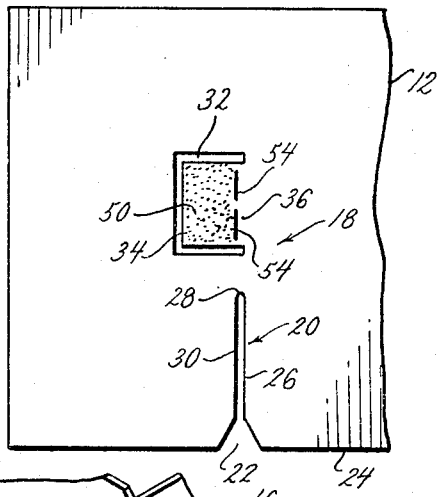
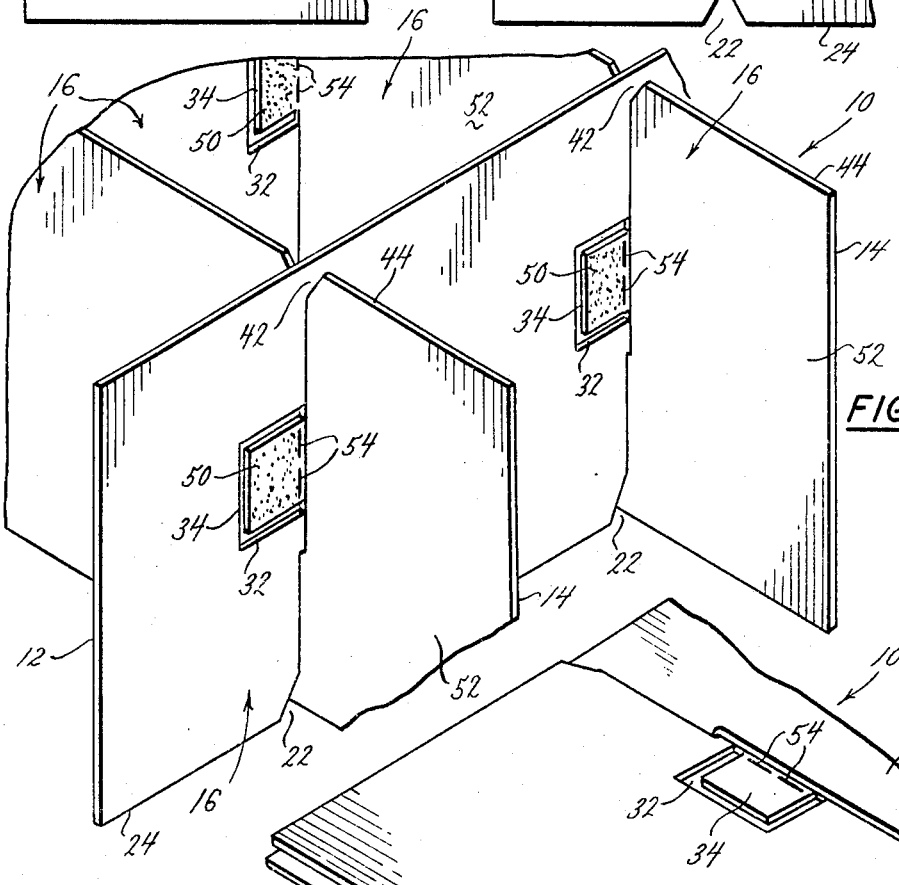
FIG. 3.
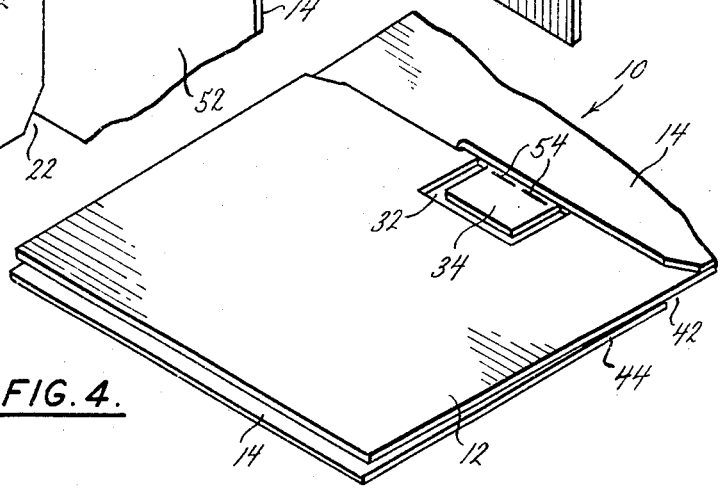
FIG. 4.

FIG. 5.
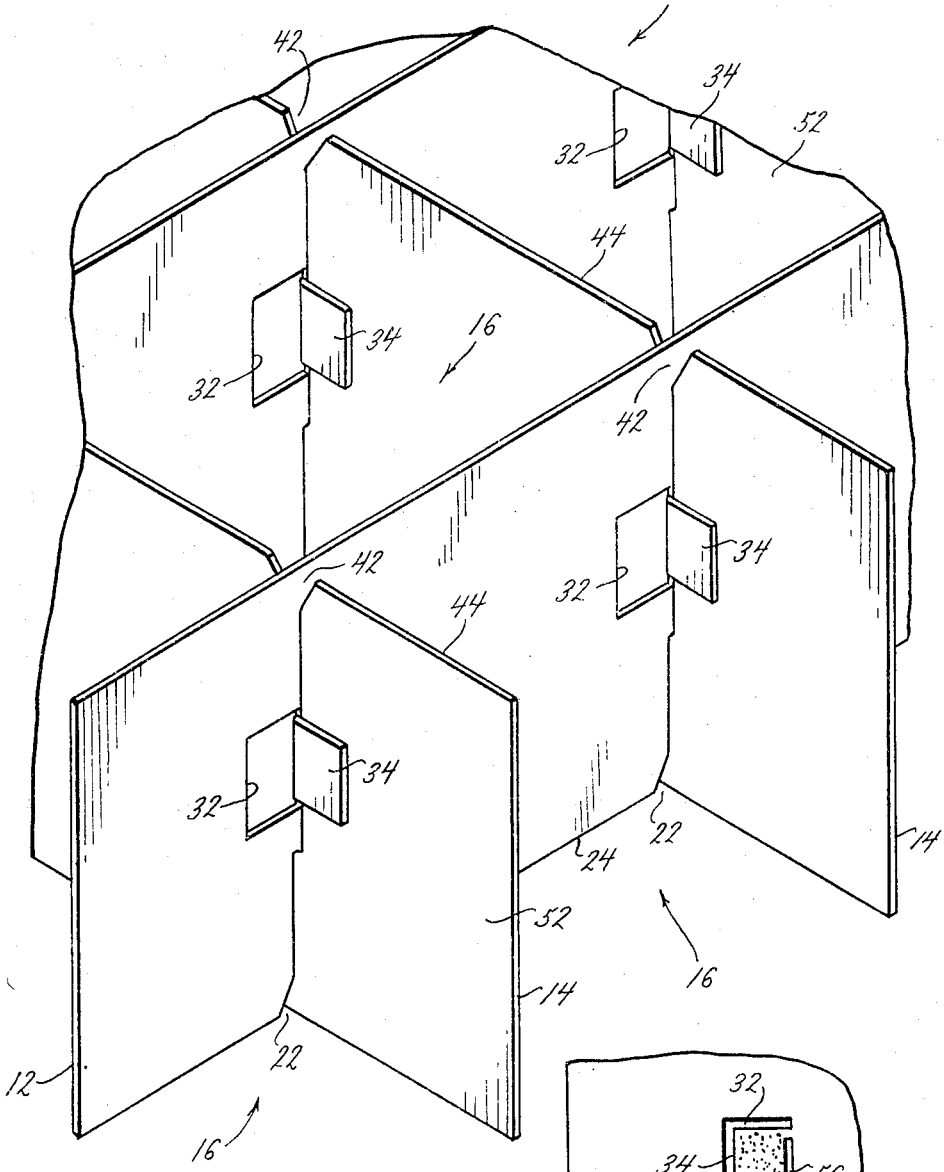
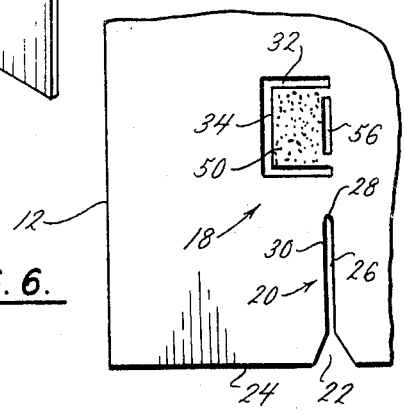
FIG. 6.

PARTITION ASSEMBLY WITH INTERLOCKS HAVING GLUED TABS

BACKGROUND AND SUMMARY OF THE INVENTION

This invention generally relates to partition assemblies, and particularly those made of paperboard material or the like having longitudinal and cross strips interlocked to provide a partition assembly having cells into which containers such as bottles, cans, or the like are inserted. More specifically, this invention relates to such a partition assembly where the longitudinal and cross strips are held engaged by interlocking slots, and further where a glued tab is utilized at each interlock of a cross strip with a longitudinal strip to securely lock the strips together.

Partition assemblies having interlocking longitudinal and cross strips are well known in the art. Examples are shown and described by U.S. Pat. Nos. 4,000,845; 3,948,435; 3,942,837, and 3,942,709. It is also known in the art to use glued flaps, tongues or tabs in a partition assembly.

George U.S. Pat. No. 2,549,801 discloses a partition assembly where the partition strips are zig-zag folded and joined to adjacent zig-zag folded strips by means of glued tongues. However, the tongues are not part of an interlock for joining cross strips.

Gepfer U.S. Pat. No. 3,942,709, owned by the same assignee as the present invention, discloses an interlocking partition with glued end flaps to stabilize the partition, but does not disclose the use of glued tabs at the interlocks.

Martin U.S. Pat. No. 4,226,357 discloses a partition having glued tabs, but the partition is formed from a single blank. The tabs are not part of an interlock for interlocking cross strips.

Other examples of partition assemblies are shown by U.S. Pat. Nos. 1,137,732, 3,446,412, 3,640,445, and 4,219,146.

The present invention specifically relates to partition assemblies having interlocking longitudinal and cross strips, and in accordance with the invention the interlocks have glued tabs to securely interlock the strips. The interlock includes a first slot in a longitudinal strip and a second slot in a cross strip, one of these slots having a tab. A side surface of the tab is adhered to a side wall of the strip having the other slot. The tab is foldable generally along the line of intersection of the longitudinal and cross strip to accommodate unfolding of the partition assembly between collapsed and expanded positions.

To assemble the partition, the longitudinal and cross strips are each formed with their respective slots. In a preferred embodiment of the invention, the cross strips have the slots with tabs. The longitudinal strips that form each partition are fed along a conveyor on their side edges such that the strips are parallel and vertically oriented. The cross strips are formed from a continuous web. The slots having the tabs are die cut for each cross strip as the web moves past the die station. Preferably, then adhesive is applied to one side of the tabs, and the strip is severed from the web. With the longitudinal strips forming each partition in transverse alignment and with their slots opening to their upper edges, the severed cross strip is fed downwardly orthogonally to the longitudinal strips such that its slots engage with aligned slots of the parallel longitudinal strips to interlock the cross strip with each longitudinal strip. This is a continuous process such that the cross strips are fed downwardly in succession to form each partition assembly after the longitudinal strips for a partition assembly are positioned as previously explained.

After each partition assembly is formed, it is collapsed from its fully expanded configuration to a collapsed configuration in a direction such that the glued sides of the tabs engage the side wall of the longitudinal strip or strips to become adhered thereto. The collapsing operation may be done by hand, or with automated equipment such as that disclosed in pending U.S. patent application Ser. No. 06/210,541, filed Nov. 28, 1980, and owned by the same assignee as the present invention. The collapsed partition assemblies are collected into bundles for shipment to the customer.

When each partition assembly is unfolded or expanded for use by the customer, the cross strips again become orthogonal to the longitudinal strips, but the tabs remain glued to the longitudinal strips such that the tabs becomes folded generally along the line of intersection of the strips. To facilitate this folding of the tab, the base of the tab may include perforations, slots or other suitable means.

By means of the glued tab interlock, the present invention provides a partition assembly with interlocking longitudinal and cross strips where the engagement between the strips is very secure and prevents inadvertent separation of the strips during handling and the automated operations to which the assemblies are subjected, and yet provides a partition which is easy to assemble.

DESCRIPTION OF THE DRAWING

FIG. 1 is a partial side view of a longitudinal partition strip showing a slot in that strip;

FIG. 2 is a partial side view of a cross partition strip showing a slot in that strip;

FIG. 3 is a perspective view of a partition assembly of the present invention in its fully expanded configuration after the longitudinal and cross strips are in engagement, but before the interlock tabs are adhered;

FIG. 4 is a perspective view of the partition assembly of FIG. 3 but shown in a collapsed or folded configuration;

FIG. 5 is a perspective view similar to FIG. 3 but showing the interlock tabs adhered to the side walls of the longitudinal strips; and FIG. 6 is a view similar to FIG. 2 and showing an alternate embodiment of the slots in the cross strips.

DETAILED DESCRIPTION OF PREFERRED EMBODIMENTS

With reference to the drawing, there is shown a partition assembly 10 of the present invention having cross partition strips 12 and longitudinal partition strips 14 preferably of paperboard material. FIGS. 3 and 5 show the partition assembly in the fully open configuration. It is to be understood that partition assemblies of the type to which this invention relates are for insertion in boxes and define generally rectangular cells 16 into which bottles, cans, and other articles are placed for shipment.

Each cross strip 12 has one or more slots 18 having a slot portion 20 with a flared opening 22 at a side edge 24 of the strip. From the flared opening 22 the slot portion 20 has a side edge 26 extending from the flared opening inwardly toward the opposite side edge 27 to a bottom edge 28, and an edge 30 extending from the bottom edge back toward the flared opening. The edges 26 and 30 are parallel and are orthogonal to the side edge 24 of the strip. The gap between the edges 26 and 30 is slightly wider than the thickness of the longitudinal strip 14.

The slot 18 also includes a generally rectangular opening 32 into which extends a generally rectangular tab 34. As shown in the drawing, the tab 34 is spaced and free from the opening on three sides thereof, allowing the tab to fold along its base 36. The base of the tab is generally in alignment with the slot portion 20.

Each longitudinal strip 14 has one or more slots 40. Each of the slots 40 has a flared opening 42 at a side edge 44, an edge 45 extending inwardly therefrom toward an opposite side edge to a bottom edge 47, and an edge 48 extending from the bottom edge back to the flared opening. The edges 45 and 48 are parallel and generally orthogonal to the side edge 44 of the strip. The gap between the edges 45 and 48 is slightly wider than the thickness of the cross strip 12.

A side surface 50 of the tab 34 has adhesive applied thereto. The cross and longitudinal strips are interlocked by engagement of the slots 18 with the slots 40 such that the bottom edge 28 of the slot portion 20 engages the bottom edge 47 of the slot 40. The depths of the slot portions 20 and slots 40 may be selected such that when fully engaged, the side edges of the cross strips and the side edges of the longitudinal strips are in alignment. While the location of the tab 34 is shown to be at a generally centralized area of the strip 12, it could be located to be closer to, or even at, one of the side edges.

FIG. 5 shows the partition assembly in the fully assembled configuration with the longitudinal and cross strips fully interlocked, and with the tabs 34 folded over with the sides of the tabs having the adhesive adhered to side walls 52 of the longitudinal strips. To facilitate the folding of the tabs 34, each of the tabs has perforations 54, as shown in FIGS. 2 through 4, or slots 56, as shown in FIG. 6, near its base. Preferably, the perforations 54 are generally in alignment with the edge 30 of the slot portion 20, or in the case of the slot 56, the slot is in alignment with the slot portion 20.

To assemble the partition assembly shown in the drawing, the longitudinal strips are brought into parallel relation with their slots transversely aligned, and with each longitudinal strip resting on its side edge 46 such that the slots open upwardly. The spacing between the parallel longitudinal strips is the same as the spacing between the slots 18 in the cross strips. Preferably, the cross strips are formed from a continuous paperboard web. The web is fed past a die station where the slots 18 are cut. Next, adhesive is applied to one side surface of the tabs 34. Then, each cross strip is severed from the web and driven downwardly into interlocking orthogonal engagement with the longitudinal strips such that the notches 18 engage the notches 40. This stage of the assembly is shown by FIG. 3 where the partition is fully expanded with the cross strips orthogonal to the longitudinal strips, and with the tabs 34 still extending into the openings 32.

Next the partition assembly is folded or collapsed to the configuration shown in FIG. 4. The partition is collapsed in a direction such that when fully collapsed, the adhesive sides of the tabs engage the side walls 52 of the longitudinal strips for adherence thereto. The partition assembly is bundled, along with other partition assemblies, in the collapsed configuration for shipment to the customer. Upon use of the partition by the customer, the partition is unfolded from its collapsed configuration shown in FIG. 4 to a fully expanded configuration as shown in FIG. 5. Upon unfolding the partition, the tabs 34 fold generally along the lines of intersection of the strips, such as along the perforations 54 or slots 56, to move out of the openings 32 and remain adhered to the side walls of the longitudinal strips.

The glued tabs provide a very secure interlock between the longitudinal and cross strips with ease of manufacture.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A partition assembly having longitudinal and cross partition strips, interlocking means for joining said longitudinal and cross strips such that said strips cross and are interlocking and generally orthogonal in an expanded configuration, wherein said interlocking means comprises a first slot in a longitudinal strip and a second slot in a cross strip, said first and second slots being in engagement to interlock the cross strip with the longitudinal strip along a line of intersection, at least one of said strips having a tab located along the line of intersection of said strips with a side surface of said tab adhered to a side wall of the other strip, said tab being foldable generally along the line of intersection of said strips to accommodate unfolding of said partition assembly between collapsed and expanded configurations.

2. The partition of claim 1 wherein said tab has means to facilitate the folding thereof.

3. The partition of claim 2 wherein said tab is slotted to facilitate folding.

4. The partition of claim 2 wherein said tab is perforated to facilitate folding.

5. The partition of claim 1 wherein said strip with said tab further comprises a tab-receiving opening into which said tab projects, and the slot of said strip with said tab having a slot portion extending to and opening at an edge of said strip.

6. The partition of claim 5 wherein said tab-receiving opening is separated from said slot portion.

7. A method of forming a partition assembly having interlocking longitudinal and cross strips comprising the steps of:

forming a longitudinal strip having a first slot therein, forming a cross strip having a second slot therein for engagement with said first slot, at least one of said strips having a tab located along the line of intersection of said strips, in any sequence, applying adhesive to one side surface of said tab, and interengaging said longitudinal and cross strips by interengagement of said slots such that said strips cross and are generally orthogonal in an expanded configuration, and adhering the adhesive side of said tab to a side wall of the other strip.

8. The method of claim 7 wherein the step of applying said adhesive occurs prior to interengaging the longitudinal and cross strips.

9. The method of claim 7 further comprising folding said interengaging strips to a collapsed configuration, such that the adhesive side of said tab adheres to said side wall.

10. The method of claim 9 wherein said tab is foldable generally along the line of intersection of said strips to accommodate unfolding said partition assembly between collapsed and expanded configurations.

11. The method of claim 10 wherein said tab has means to facilitate the folding thereof.

12. The method of claim 7 wherein said strip with said tab is formed with a tab-receiving opening into which said tab projects, and the slot of said strip with said tab having a slot portion extending to and opening at an edge of said strip.

* * * * *